US008474071B2

(12) United States Patent
Tricault et al.

(10) Patent No.: US 8,474,071 B2
(45) Date of Patent: Jul. 2, 2013

(54) SELF-DEPLOYABLE COT

(75) Inventors: Jérôme Tricault, Langoiran (FR); Emmanuel Sordoillet, Anglet (FR)

(73) Assignee: Serpolet, Langoiran (FR)

( * ) Notice: Subject to any disclaimer, the term of this patent is extended or adjusted under 35 U.S.C. 154(b) by 0 days.

(21) Appl. No.: 13/515,700

(22) PCT Filed: Dec. 15, 2010

(86) PCT No.: PCT/FR2010/052746

§ 371 (c)(1),
(2), (4) Date: Aug. 22, 2012

(87) PCT Pub. No.: WO2011/080457

PCT Pub. Date: Jul. 7, 2011

(65) Prior Publication Data

US 2012/0311782 A1 Dec. 13, 2012

(30) Foreign Application Priority Data

Dec. 15, 2009 (FR) ..... 09 58979

(51) Int. Cl.
*A47D 7/00* (2006.01)

(52) U.S. Cl.
USPC ..... 5/99.1; 5/97

(58) Field of Classification Search
USPC ..... 5/99.1, 98.1, 97; 135/124–126, 905
See application file for complete search history.

(56) References Cited

U.S. PATENT DOCUMENTS

| | | | | |
|---|---|---|---|---|
| 5,385,165 | A | 1/1995 | Hazinski et al. | |
| 5,800,067 | A | 9/1998 | Easter | |
| 5,809,592 | A * | 9/1998 | McAllister | 5/99.1 |
| 2006/0117478 | A1 | 6/2006 | Cheung | |

FOREIGN PATENT DOCUMENTS

| | | | |
|---|---|---|---|
| GB | 2 451 651 | A | 2/2009 |
| WO | 00/26488 | A1 | 5/2000 |

OTHER PUBLICATIONS

International Search Report for PCT/FR2010/052746 dated Apr. 27, 2011.

* cited by examiner

*Primary Examiner* — Fredrick Conley
(74) *Attorney, Agent, or Firm* — Sughrue Mion, PLLC

(57) ABSTRACT

A self-deployable device (1) for a child, comprising an arcuate structure (110, 120) capable of supporting in the deployed state at least one wall (20) made of flexible material defining a space for receiving a child, and at least one stiffener bar (200, 201) to withstand bearing against the arcuate structure. Just one (210, 211) of the two ends of the bar is secured to the arcuate structure by a fixed connection, such that said bar is able to remain connected to the arcuate structure when said structure passes from the folded-up state to the deployed state and/or vice versa.

10 Claims, 2 Drawing Sheets

SELF-DEPLOYABLE COT

CROSS REFERENCE TO RELATED APPLICATIONS

This application is a National Stage of International Application No. PCT/FR2010/052746 filed on Dec. 15, 2010, which claims priority from French Patent Application No. 0958979, filed on Dec. 15, 2009, the contents of all of which are incorporated herein by reference in their entirety.

The present invention relates to the field of cots or cribs and more particularly portable cots.

Travel cots or fold-up cots are generally known, said cots forming a sleeping area which is defined by a substantially rectangular surface. The sleeping area is defined by substantially vertical flexible walls held in place by uprights at the four corners of the sleeping area. The uprights are held in place by tubes which cross at their base and by four tubes connected at the upper ends. Said fold-up cots generally have a safety device to prevent the cot from being inadvertently folded up.

However, said fold-up cots are heavy to carry, bulky even when folded up, and complicated to use and in particular to fold up again.

Baby beds are also known, and more particularly cribs, of which the structure for retaining the sleeping area is in the form of an arch.

Said baby beds have a major drawback: when the child grows and wishes to rest on the structure, said structure collapses and the child is then able to climb out of the sleeping area.

The document U.S. Pat. No. 5,809,592 discloses a play pen for a child comprising two flexible loops, two vertical support bars, each connecting the loops together, and a horizontal bar between two ends of the same loop. Said bars are removably fixed to the loops. The bars thus have to be fixed each time the play pen is installed and removed after each use.

There is a need for a device for a play area for children which is easier to set up and/or to dismantle.

There is provided a self-deployable children's area device, comprising an arcuate structure capable of supporting in the deployed state at least one wall made of flexible material, defining a space for receiving a child and at least one stiffener bar to withstand a bearing against the arcuate structure, wherein a single on of the two ends of the bar is secured to the arcuate structure by a fixed connection, such that said bar is able to remain connected to the arcuate structure when said structure passes from the folded-up state to the deployed state and/or vice versa.

For example, the other end, also called free end, may thus be secured to the structure by a reversible connection, or said other end may be not fixed to the arcuate structure. In the first case, the connection may be formed by locking and/or released by unlocking, i.e.; for example the user releases the free end of the structure by releasing a locking element, or the connection may be more simply formed and/or released by displacement of the bar. In the second case, corresponding to the absence of link between the free end and the structure, it is possible to provide the free end with a non-slip coating of the rubber type, for example, in order to ensure a good grip with the floor or the like.

Thus, due to the fixing of one end and to the reversible nature (or the absence) of the fixing of the other end of the bar to the arcuate structure, the set-up and/or storage of the device is facilitated. The bar may, so to speak, follow the arcuate structure when said structure passes from the deployed state to the folded-up state and/or vice versa, which makes it possible to avoid the steps of positioning the bar assembly during installation of the device and removal of the bar during storage.

The term "self-deployable" is understood to be that the device is capable of being folded, in particular for the storage thereof and/or the transport thereof, but its position of equilibrium in the absence of stress is the deployed state.

The fixed connection securing the so-called non-free end of the bar to the structure is normally designed so that the user is incapable of releasing this connection in normal conditions of use. It is possible to provide a connection capable of being occasionally released, for example to permit a repair or change of parts, provided that the device is arranged such that during deployment and/or folding up, the stiffener bar is able to remain secured to the arcuate structure. The device is thus arranged such that the bar does not constitute an obstacle to the deployment and/or to folding up of the structure. The presence of the stiffener bar is thus less restricting for the user during deployment and/or folding up of the device than in the prior art.

The bearing that the bar is able to withstand may, for example, be caused by a child who wishes to climb out of the space which is dedicated to him/her by rocking the device.

In the deployed state, the bar makes it possible reinforce the structure by playing a stiffening role, in particular, and may enable bearing against the arcuate structure to be withstood by abutting against a floor element. The floor element may, for example, be the floor itself, a bottom loop designed to be arranged on the floor, a wall made of flexible material supported by the bottom loop, or the like.

The bar may be permanently or semi-permanently in contact with the floor element when the device is in the deployed state, or even just in the case of bearing. In the second case, it is possible to provide that in the absence of bearing, the free end of the bar is a few centimeters from the floor element.

The device disclosed above may also be without external points, such as stakes, for example, as may be found in a tent or hammock.

The free end may, for example, be secured by a reversible connection directly to one or more arch(es) of the arcuate structure, for example a bottom loop designed to rest entirely on the floor or even on a wall made of flexible material supported by one or more arches, for example a wall made of flexible material supported by the bottom loop, or even a wall made of flexible material which is upright in the deployed state, supported by an arch which is upright in the deployed state.

When releasing the free end of the structure by displacement of the bar, said displacement may be brought about by a user for the purpose of folding up the device, or even the bar may release itself in the absence of bearing and remain in the free state, for example at a few centimeters from any floor element. When the displacement is brought about by a user, the device may be arranged such that the user deliberately pulls the bar in order to release the connection between the free end and the arcuate structure. Alternatively, the device may be arranged such that the bar is driven by the remainder of the structure when folded up which may make it possible for the user to avoid specifically handling the stiffener bar.

Similarly, when the free end is secured to the structure by a displacement of the bar, said displacement may be expressly brought about by a user, or even driven by the movements of the arcuate structure during deployment. Also, when the bar remains at a certain distance from the floor element in the absence of bearing, the securing may take place only in the case of bearing, for example by a child.

Advantageously, the device may comprise guide means for guiding the free end of the bar when the device passes from the deployed state to the folded up state and/or vice versa. Said guide means may make it possible to ensure correct positioning of the stiffener bar and, as a result, limit the number of user gestures.

The guide means may be produced, for example, from flexible material, thus permitting the weight of the device to be limited. Said guide means may, for example, comprise a sleeve made of flexible material sewn to a wall of the device made of flexible material.

The invention is not in any way limited to guide means made of flexible material. For example, it is possible to provide guidance of the bar in a cylindrical element made of plastics or metal.

Advantageously, the device may be arranged so as to define at least one housing to receive the free end of the bar in the deployed position. Such a housing, emerging on one or both sides, may allow to permit the correct positioning of the bar to be ensured in the deployed position. Said housing may, for example, be formed by an eyelet in the wall made of flexible material on the floor, supported by the bottom loop, or even formed by a recess in the bottom loop, or even formed in an upright wall made of flexible material, or the like. The eyelet may have edges made of flexible or rigid material.

The housing may comprise an eyelet, such that the structure is relatively simple, but the invention is not limited in any way to housings of this type. In particular, the housing may be formed by relatively high guide walls, for example of more than 2.5 or 10 centimeters, capable of covering a portion of the stiffener bar. Such a housing may be formed from flexible material: it is possible, for example, to provide a fabric pocket sewn to an upright wall made of flexible material and arranged such that the bottom of the pocket reaches a floor element when a child bears thereagainst. Alternatively, said housing may be made of a rigid material: it is possible, for example, to provide a cylindrical element made of metal or plastics, of which the base is fixed to a bottom arch designed to rest entirely on the floor and of which the internal diameter is slightly greater than a diameter of the stiffener bar, so that said bar may be received in the cylindrical element.

Advantageously, the arcuate structure may be maintained in the deployed position by at least one means for maintaining the structure in the extended position capable of withstanding the forces which tend to separate the elements of the structure. The means for maintaining the structure in the extended position may permit, in particular, the forces of the structure to be withstood. More specifically, the structure may tend to open naturally as a result of its configuration. The forces may also result from a person seeking to push the elements of the structure outside the area for the child, such as for example a child inside or outside said area.

In particular, the means for maintaining the structure in the extended position may comprise at least the wall made of flexible material capable of retaining the structure. The wall made of flexible material may be associated with a strap to strengthen the assembly.

The invention is not limited to the shape of the arcuate structure used.

Advantageously, the arcuate structure may comprise at least one first arch forming a bottom loop capable of resting on the floor and at least one second, upright arch in the deployed position, of which the front view is substantially U-shaped, the second arch being capable of supporting at least the wall made of flexible material.

In particular, it is possible to provide two stiffener bars respectively secured to the two top points of the second arch.

Advantageously, in the deployed state, the space for receiving a child is defined by one or more substantially vertical walls relative to the floor and/or relative to the bottom loop.

The term "substantially" is understood as a deviation of less than or equal to 10%, and advantageously less than or equal to 5%.

The area for the child may, for example, be contained within four substantially vertical walls and a base, the opposing side at the base remaining open or possibly closed, for example by a mosquito net.

The device may comprise a cot and the area may be a sleeping area. The sleeping area may be configured so as to permit the installation of a mattress with substantially rectangular faces.

Alternatively, it could be possible to provide that the device is a children's play pen, and that the area is a play area.

Advantageously, the device comprises a means for reinforcing the wall made of flexible material to withstand bearing against said wall. More specifically, the child may attempt to climb out of the area which is dedicated to him/her by climbing over the wall, for example, and said reinforcement means may make it possible to stiffen the wall and limit sagging, in particular when the flexible material is worn.

Said means may advantageously comprise one or more bars secured to the wall. It is possible, for example, to provide a substantially horizontal reinforcement bar when the device is deployed, arranged in the vicinity of an upper edge of the wall, and a substantially vertical reinforcement bar, arranged so as to come into abutment, on the one hand, with the substantially horizontal bar and, on the other hand, with a floor element in the case of bearing against the substantially horizontal bar. The reinforcement means may thus be put in position in a relatively simple manner, without modifying the flexible material itself.

Advantageously, the bar(s) of the reinforcement means has/have a length which is less than or equal to the maximum dimension of the device in the folded-up state. Thus, if said bar(s) is/are arranged judiciously, the passage from the deployed state to the folded-up state and/or vice versa may be carried out without a step dedicated to the reinforcement means, the type of fixing of the bar or the like.

The deployable structure thus defined is lighter than a traditional travel cot and also provides better support than a crib in the case of the child bearing thereagainst.

It is possible that the wall made of flexible material defines a second sleeping area, for example for a second child.

Also proposed is a method for deploying or folding up a device for a child which is self-deployable, comprising an arcuate structure capable of supporting in the deployed state at least one wall made of flexible material, defining a space to receive a child, and at least one stiffener bar to withstand bearing against the arcuate structure, wherein during said deployment or said folding up just one of the two ends of the bar is secured to the arcuate structure by a fixed connection. The bar thus remains connected to the arcuate structure when said structure passes from the folded-up state into the deployed state and/or vice versa.

The invention will now be disclosed with reference to the non-limiting drawings, in which.

Figure 1:
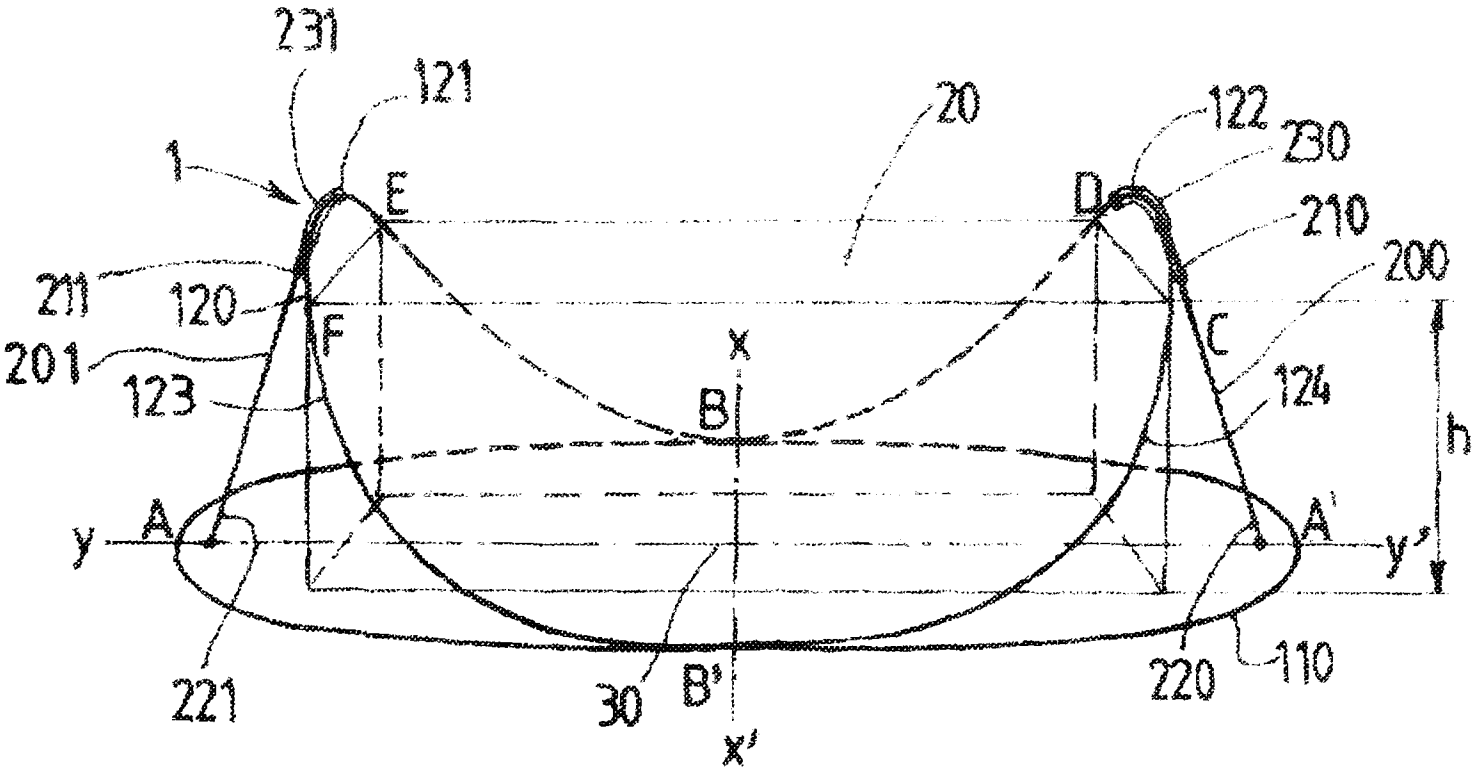
FIG. 1 shows in a very schematic manner an example of a cot according to a first embodiment of the invention.

According to the first non-limiting embodiment, shown in FIG. 1, a cot 1 is formed from a deployable arcuate structure. Said structure comprises two arches 110, 120 of which the first arch 110 forms a bottom loop capable of resting on the floor and a second upright arch 120 of which the front view in the deployed position is substantially U-shaped, the branches thereof having the tendency to be separated from one another.

The longitudinal axes (xx', yy') of said loops are substantially perpendicular to one another.

The two longitudinal ends (B, B') of the support loop 120 are associated with the two transverse ends of the bottom loop 110 such that the bottom loop 110 extends substantially in one plane and the support loop 120 forms two arches 123, 124 extending upward.

The two arches 123, 124 provide, in particular, the retention of a flexible wall 20 at four points C, D, E and F, substantially forming a rectangle. The flexible wall is composed of one or more parallelepiped elements.

In the example shown, the walls are of substantially the same height h, for example 60 or 70 centimeters. According to a further example, not shown, it is possible to conceive that the opposing pairs of sides of the parallelepiped shape have similar heights, the adjacent sides being of a different height.

Advantageously, the walls are substantially perpendicular to the floor, i.e. they are at an angle of +/−10° or less relative to the vertical.

The structure is retained in the deployed position by the wall 20 which acts as a means of maintaining the structure in the extended position on the arches 123, 124. More specifically, the wall 20 makes it possible to withstand the forces tending to separate the arches 123, 124 from one another.

Two stiffener rods or bars 200, 201 make it possible to limit the risk of the device falling over by preventing the points 121, A and 122, A' from approaching one another.

Said bars 200, 201 each have a first respective end 210, 211 and a second respective end 220, 221. The first ends are secured to the respective upper points 122, 121 of the loop 120 by means of a T-shape made of plastics 230, 231. The vertical branch of the T-shape 230 receives the end 210 whilst the horizontal branches of said T-shape 230 receive the ends of the loop 120 in the region of the top point 122, and in the same manner, the vertical branch of the T-shape 231 receives the end 211, whilst the horizontal branches of said T-shape 231 receive the ends of the loop 120 in the region of the top point 121. The securing of the first ends 210, 211 to the arcuate structure is thus permanent, the T-shape being designed not to be released by a user.

In contrast, the second ends 220, 221 are simply designed to be received in respective eyelets (not shown) of a fabric wall supported by the bottom loop 110.

The structure is composed, for example, of tubes having a diameter of 5 mm. The stiffener bars 200, 210 and the loops 110, 120 may be made of glass fibers, for example.

The bottom loop 110 has an unfolded length of approximately 4860 mm.

The support loop 120 has an unfolded length of approximately 4028 mm.

Figure 2:
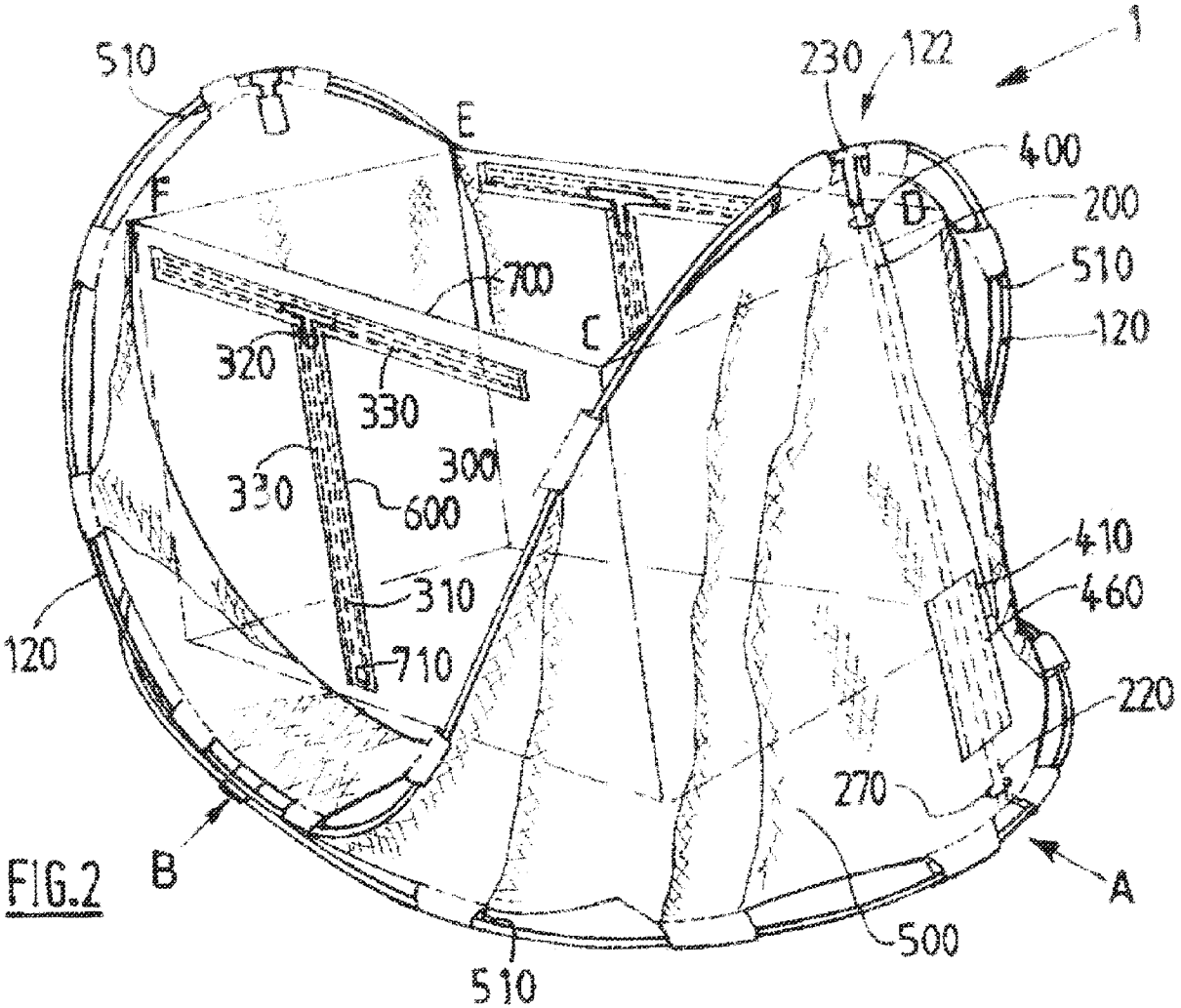
FIG. 2 is a more accurate view of a cot according to the first embodiment.

With reference to FIG. 2, the structure is clad with an envelope 500 comprising at least six different sections. One section may be used for a plurality of parts.

- A first substantially rectangular section corresponding to the sides of the sleeping area and a second also substantially rectangular section but of more reduced dimension, corresponding to the ends of the sleeping area.
- A third section and a fourth section, capable of closing the surfaces extending between the sides of the sleeping area and the support loop 120 of which the shape is delimited by the chord of a circle and its circumference. By way of example, the third section has a chord of 600 mm and a height of 158 mm, the fourth section has a chord of 1653 mm and a height of 207 mm.
- A fifth section, capable of closing the external surfaces of the structure extending between the points 121, A, B and B' and the symmetrical points 122, A', B and B' thereof.
- A sixth substantially oval section, capable of closing the bottom of the structure, having the following dimensions: 1500 mm between the points A and A' and 1000 mm between the points B and B'.

To all these sections it is necessary to add the overhangs which are necessary for assembly and which may extend, for example, between 20 mm and 30 mm.

The envelope 500 is supported by the arcuate structure by means of fabric sleeves 510.

The deployable structure 110, 120 disclosed in FIG. 1 is advantageously a self-deployable structure, well known by the person skilled in the art.

The arches, once folded up by a method well known by the person skilled in the art, form a circle having a diameter ranging from 60 to 90 cm in diameter.

As shown in FIG. 2, a pocket 600 is sewn to the first section to receive a horizontal reinforcing bar 300 and a vertical reinforcing bar 310. Said bars each have an appropriate length, for example of 60 cm, so that said bars do not constitute an obstacle to the folding-up process.

The distance between the points F and C may, for example, be approximately 1 meter. The person skilled in the art will understand that the figures are not necessarily to scale and will know how to carry out the necessary adaptations, if necessary.

The person skilled in the art will understand that the folding-up of the arches, well known per se, is not hindered by the presence of the bars 300, 310, 200, 210. The stiffener bars 200, 210 are fixed to the upper arch by using a T-shape made of plastics 230, 231 and sliding in a guide system along the lower arch. Said system permits the set-up during deployment and the folding-up to be carried out automatically, without requiring a dismantling or unlocking action on the part of the user. During the deployment or folding-up phases, the user only has to control the "pop-up" system, i.e. form a figure of eight with the two arches for folding up. All the additional stiffening elements 300, 310, 200, 210 are automatically set up and folded up.

The bars 300, 310, in this case made of glass fibers, are secured to one another by a T-shape made of plastics 320. The seams 330 permit the bars 300, 310 to be held in place.

The vertical bar 310 has one end secured to the horizontal bar 300, and the other end 710 located at a few centimeters from the bottom of the sleeping area. If the child bears against the upper edge 700, said other end 710 comes into abutment and makes it possible to withstand the forces associated with the bearing of the child thereagainst.

Alternatively, in an embodiment which is not shown, it is possible to provide that the bottom end of the vertical bar reaches the bottom of the wall, even emerging as far as the floor by passing through the eyelets formed in the envelope. For example, the height h of the walls may be 60 centimeters and the length of the vertical bar may also be equal to approximately 60 centimeters. In this case, it is possible to provide that the horizontal bar is retained in a hem of the upper edge.

Referring back to FIG. 2, the fifth section comprises an opening 400 formed in the envelope to allow the corresponding stiffening bar 200 to pass through. A sleeve 410 is also fixed to this fifth section by means of seam lines 460 to guide the corresponding bar 200 by sliding. When the structure is deployed, said sleeve 410 constitutes a guide means to bring the second end 220 of the bar 200 toward a corresponding metal eyelet 270 formed in the sixth section. When the structure is folded up, the sleeve 410 makes it possible to ensure that the bar 200 does not interfere with the folding up.

For greater clarity, in FIG. 2 the pocket 600 and the sleeve 410 have been shown as external but it is understood that, for aesthetic reasons, it may be advantageous to place them inside the envelope.

Also, for greater clarity, only one of the stiffener bars 200, 210 has been shown in its entirety in FIG. 2. It is understood that a further stiffener similar to that explicitly shown in FIG. 2 is located on the other side of the sleeping area.

As a variant, it could be provided that, for each stiffener bar during deployment, the bottom end of the bar is guided by the user or by a guide means of the sleeve type in a receiving element with a recess of internal diameter which is slightly greater than the external diameter of the bar. Said introduction triggers a movement of a locking element of the receiving element, said movement leading to the blocking of the bar. Said locking element may be located in the region of the passage of the bar and may, for example, comprise a spring and a recessed part capable of being pushed by the spring. The recess of the recessed part has substantially the same diameter as that of the receiving element. In the locked position, due to the thrust of the spring, the recessed part applies transverse forces against the corresponding stiffener bar portion, said forces being sufficient to prevent, or make more difficult, the removal of the bar. When folded up, the user presses on one emerging end of the recessed part which constitutes a type of button. As the bearing force is in the direction opposing that of the thrust force of the spring, the recessed part is displaced. When the recess of the recessed part is substantially aligned with the recess of the receiving element and the recessed part applies a sufficiently weak force against the bar, the bar may be removed more easily by the user or by the entrainment associated with the folding-up of the structure.

In the present application, the terms "top", "bottom", "upper", "lower", "horizontal", "vertical" are to be taken as being the usual meaning of the terms, the floor being assumed to be horizontal or substantially horizontal and at the bottom and lower relative to the deployed device positioned on the floor.

The invention claimed is:

1. A self-deployable device for a child, comprising an arcuate structure capable of supporting in the deployed state at least one wall made of flexible material defining a space for receiving a child, at least one stiffener bar to withstand bearing against the arcuate structure, wherein a single one of the two ends of the bar is secured to the arcuate structure by a fixed connection, such that said bar is able to remain connected to the arcuate structure when said structure passes from the folded-up state to the deployed state and/or vice versa.

2. The device as claimed in claim 1, further comprising guide means for guiding the other of the ends of the bar when the device passes from the deployed state to the folded-up state and/or vice versa.

3. The device as claimed in claim 2, wherein the guide means comprises a sleeve sewn into a wall made of flexible material and configured so as to be able to receive the stiffener bar.

4. The device as claimed in claim 2, arranged so as to define at least one housing to receive the other of the ends of the bar in the deployed position.

5. The device as claimed in claim 4, wherein the housing is defined by an eyelet fixed to a wall made of flexible material.

6. The device as claimed in claim 1, further comprising a means for reinforcing the wall to withstand bearing against a wall made of flexible material.

7. The device as claimed in claim 6, in wherein the reinforcement means comprises a substantially horizontal reinforcement bar when the device is deployed, arranged in the vicinity of an upper edge of the wall, and a substantially vertical reinforcement bar arranged so as to come into abutment, on the one hand, with the substantially horizontal bar and, on the other hand, with a floor element in the case of bearing against the substantially horizontal bar.

8. The device as claimed in claim 7, wherein at least one reinforcement bar has a length which is less than or equal to the maximum dimension of the device in the folded-up state.

9. The device as claimed in claim 1, wherein the arcuate structure comprises at least one first arch forming a bottom loop capable of resting on the floor and at least one second, upright arch, in the deployed position, of which the front view is substantially U-shaped, the second arch being capable of supporting at least the wall made of flexible material.

10. The device as claimed in claim 1, in wherein said device is a cot.

* * * * *